US005517913A

United States Patent [19]

Oshio et al.

[11] Patent Number: 5,517,913

[45] Date of Patent: May 21, 1996

[54] STENCIL PRINTING DEVICE USING A SENSOR FOR DETECTING AN INK TYPE

[75] Inventors: Susumu Oshio; Kenji Oshima, both of Tokyo, Japan

[73] Assignee: Riso Kagaku Corporation, Tokyo, Japan

[21] Appl. No.: 169,649

[22] Filed: Dec. 20, 1993

[30] Foreign Application Priority Data

Dec. 28, 1992 [JP] Japan ..... 4-348487

[51] Int. Cl.[6] ..... B41F 15/40

[52] U.S. Cl. ..... 101/119; 101/484; 101/DIG. 45

[58] Field of Search ..... 101/119, 120, 101/123, 124, 129, 484, 491, DIG. 45

[56] References Cited

U.S. PATENT DOCUMENTS

| | | | |
|---|---|---|---|
| 4,385,558 | 5/1983 | Takahashi et al. | 101/120 |
| 4,563,947 | 1/1986 | Matsushita et al. | 101/122 |
| 4,693,179 | 9/1987 | Watts | 101/119 |

FOREIGN PATENT DOCUMENTS

| | | | |
|---|---|---|---|
| 89347 | 4/1988 | Japan | 101/484 |
| 151473 | 6/1990 | Japan | 101/119 |

OTHER PUBLICATIONS

Patent Abstracts of Japan, vol. 14, No. 399 (M-1017) 29 Aug. 1990.

Patent Abstracts of Japan, vol. 15, No. 124 (M-1097) 26 Mar. 1991.

*Primary Examiner*—Christopher A. Bennett
*Assistant Examiner*—Stephen R. Funk
*Attorney, Agent, or Firm*—Dickstein, Shapiro & Morin

[57] ABSTRACT

In a stencil printing device in which printing ink is supplied to the inner surface of a printing drum, and printing paper is pressed onto a stencil master plate sheet mounted on the outer circumferential surface of the printing drum by using a press roller for effecting a stencil printing on the printing paper, there are provided dip switches in the printing drum for identifying the type of the printing ink supplied to the inner surface of the printing drum, and the pressing force of the press roller against the printing drum is variably determined according to the detected type of the printing ink set on the dip switches so that a stencil printing is carried out with a prescribed printing density without regard to the type of ink, in particular the color of the printing ink used with the printing drum. An alternative device determines material properties of the ink including temperature, color, viscosity and opacity of the ink so that pressing force of the roller against the printing drum can be variably determined.

9 Claims, 5 Drawing Sheets

STENCIL PRINTING DEVICE USING A SENSOR FOR DETECTING AN INK TYPE

TECHNICAL FIELD

The present invention relates to a stencil printing device, and in particular to a stencil printing device which can interchangeably use a plurality of printing inks of different types, in particular printing inks having different colors.

BACKGROUND OF THE INVENTION

In a single drum stencil printing device, printing ink is supplied to the inner surface of a cylindrical printing drum, and printing paper is pressed onto a stencil master plate sheet wrapped around the outer circumferential surface of the printing drum by using a press roller so that a desired stencil printing by the printing ink may be carried out on the printing paper.

A stencil printing device of this type may be provided with interchangeable printing drums each of which may be selectively mounted on a printer main body so that stencil printing of different colors may be carried out by changing the printing drums. Such a stencil printing device is, for instance, disclosed in Japanese patent publication (kokoku) No. 62-28758.

The printing ink used in such stencil printing devices normally consists of emulsions containing pigments, resin, solvents, surface reactants, and water, and the viscosity of the printing ink is known to depend on temperature. The viscosity of the printing ink affects the amount of ink transferred to the printing paper in the stencil printing process, and this in turn causes a change in the printing density and other printing qualities (such as uniformity in the density of dark areas).

In view of such problems, it has been proposed, for instance in Japanese patent laid open publication (kokai) No. 02-151473, to variably set the pressing force or the pressure of the press roller upon the printing drum in dependence on temperature so that the stencil printing may be carried out with a constant printing density without regard to the change in temperature.

The viscosity of printing ink is affected not only by temperature but also by differences in the compositions and properties of pigments, resins, solvents, surface reactants, and water contents. The color of the printing ink, and the type and particle diameter of pigments also affect the viscosity of the printing ink. Thus, the type (in particular the color) of the printing ink affects the printing density.

Furthermore, the tinting strength (opacity) of each pigment depends on its color or its type, and this also affects the printing density.

BRIEF SUMMARY OF THE INVENTION

In view of such problems of the prior art, a primary object of the present invention is to provide a stencil printing device which can carry out a stencil printing process with a constant printing density without regard to the type of the printing ink, in particular the color of the printing ink.

A second object of the present invention is to provide a stencil printing device which achieves an optimum printing result even when the printing drum is changed with another for using a printing ink of a different type, in particular of a different color.

According to the present invention, these and other objects of the present invention provide a stencil printing device for carrying out a stencil printing on printing paper by pressing the printing paper with a press roller upon a stencil master plate sheet mounted on an outer circumferential surface of a cylindrical printing drum having printing ink supplied to the inner surface of the printing drum, comprising:

ink type detecting means for detecting a type of the printing ink supplied to the inner surface of the printing drum; and pressing force varying means for variably setting the magnitude of a pressure of the press roller exerted upon the printing drum according to the type of the printing ink detected by the ink type detecting means.

Typically, the ink type detecting means detects a color of the printing ink as the type thereof, and the pressing force varying means variably sets the magnitude of the pressure of the press roller upon the printing drum according to the color of the printing ink detected by the ink type detecting means.

According to the stencil printing device of the present invention, the type, in particular the color of the printing ink is detected by the ink type detecting means, and the pressing force of the press roller upon the printing drum is variably set by the pressing force varying means to an optimum value according to the detection result or the type of the printing ink. It is thus possible to achieve a constant printing density without regard to the type of the printing ink, in particular the color of the printing ink.

According to a preferred embodiment of the present invention, the printing drum is detachably mounted on a main body of the stencil printing device so as to be interchangeable with another printing drum for using a different printing ink for each printing drum, and each printing drum is provided with switch means whose setting is associated with a type of the printing ink associated with the printing drum and can be detected by the ink type detecting means provided in the main body of the stencil printing device.

The switching means may consist of not only dip switches which can be manually set, but also optical, magnetic or other code means which can be coded in advance and can be read by suitable optical, magnetic or other sensors. It is also possible to optically detect the actual color of the printing ink by a suitable optical sensor.

Also, the type of the printing ink is not limited by the color but may consist of other properties of the printing ink which can be directly detected by a suitable sensor. The properties of the printing ink may consist of a value corresponding to a temperature of the printing ink, a value corresponding to a viscosity of the printing ink, or an opacity of the printing ink.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
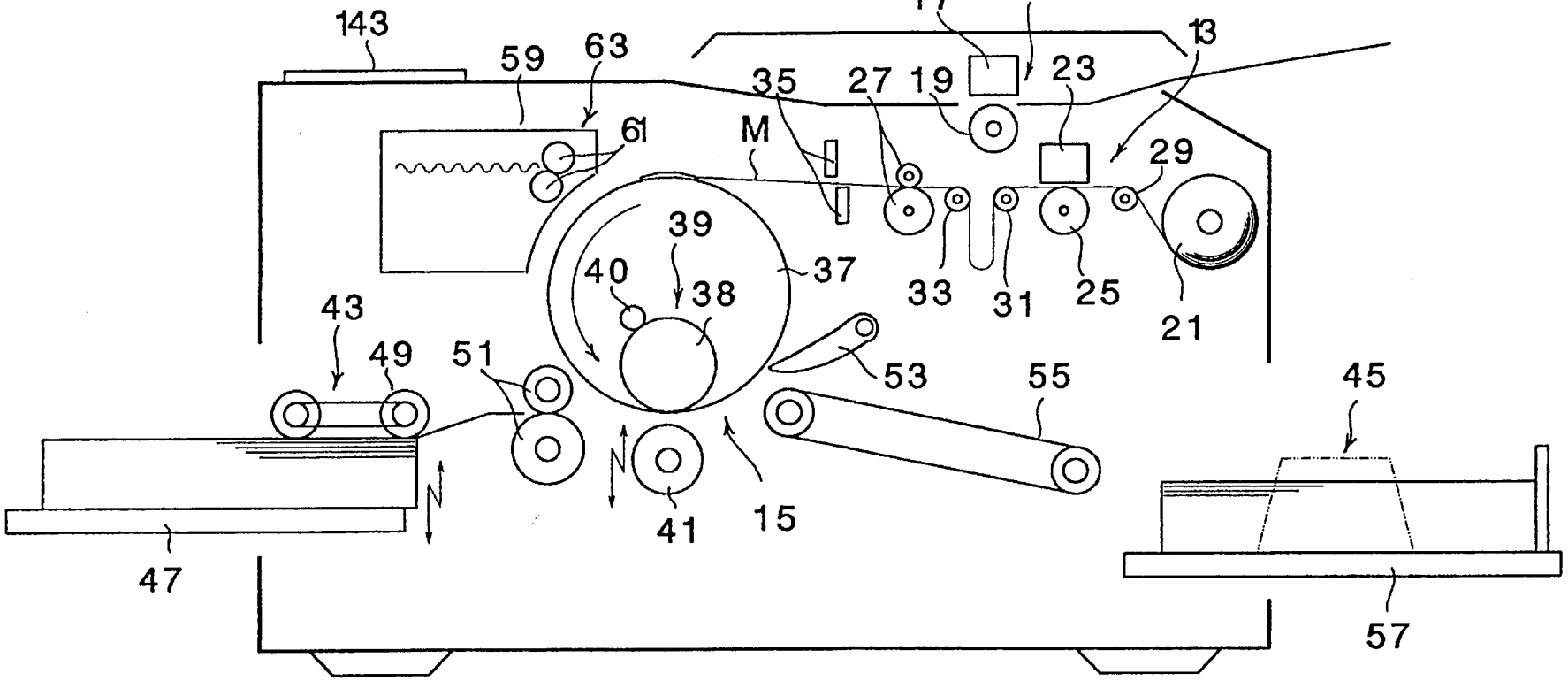
FIG. 1 is a schematic structural view of an embodiment of the stencil printing device according to the present invention as applied to a stencil printing device equipped with the function of making master plates.

FIG. 1 shows one of the preferred embodiments of the stencil printing device equipped with the function of making stencil master plates according to the present invention. This stencil printing device comprises an original reading unit 11, a plate making unit 13, and a printing unit 15.

The original reading unit 11 essentially consists of an image scanner, and comprises a line image sensor 17 for reading an original image of an original sheet conveyed in a secondary scanning direction, and an original sheet feeding roller 19.

The plate making unit 13 comprises a stencil sheet roll unit 21, a thermal printing head 23 consisting of a plurality of dot-like heat generating elements arranged in a lateral row, master plate sheet feeding rollers 25 and 27, master plate sheet guide rollers 29, 31 and 33, and a master plate sheet cutter 35. The dot-like heat generating elements in the thermal printing head 23 are selectively activated so that a desired thermal perforation may be carried out on the master plate sheet M, which is heat sensitive, as a plate making process, and the master plate sheet cutter 35 cuts the stencil master plate sheet M after the latter is processed into a master plate.

The printing unit 15 comprises a cylindrical printing drum 37 made of a perforated metal plate, a mesh structure or an otherwise ink permeable porous structure, an ink supplying unit 39 essentially consisting of a squeegee roller 38 and a doctor roller 40 disposed inside the printing drum 37, and a press roller 41, and the stencil master plate sheet M after being processed into a master plate is mounted on the outer circumferential surface of the printing drum 37.

On one side of the printing unit 15 is provided a paper feeding unit 43, and on the other side of the printing unit 15 is provided a paper ejecting unit 45.

The paper feeding unit 43 comprises a paper feeding table 47 on which a stack of printing paper P is placed, pick up rollers 49 for picking up the printing paper P on the paper feeding table 47 sheet by sheet, and timing rollers 51 for delivering the printing paper P to the nip between the printing drum 37 and the press roller 41.

The paper ejecting unit 45 comprises a peeling claw 53 for removing the printing paper from the printing drum 37, an ejected paper feeding belt 55, and an ejected paper table 57 for stacking up the printed printing paper.

On one side of the printing unit 15 is provided a master plate ejecting unit 63 comprising master plate ejecting rollers 61 for peeling off the used stencil master plate sheet M from the printing drum 37 and delivering it into an ejected master plate box 59.

In this stencil printing device, printing ink of a desired color is supplied by the ink supplying unit 39 into the inner surface of the printing drum 37 while the printing drum 37 is rotated counter clockwise in the drawing around its central axial line by rotative drive means not shown in the drawings. Printing paper P is delivered to the nip between the press roller 41 and the printing drum 37 after being fed by the paper feed timing rollers 51 from left to right in synchronism with the rotation of the printing drum 37 at an appropriate timing. The printing paper P is thus pressed upon the printing drum 37 by the press roller 41 onto the stencil master plate sheet M mounted on the outer circumferential surface of the printing drum, and a stencil printing is carried out on the printing paper P by using the printing ink of the desired color.

Figure 2:
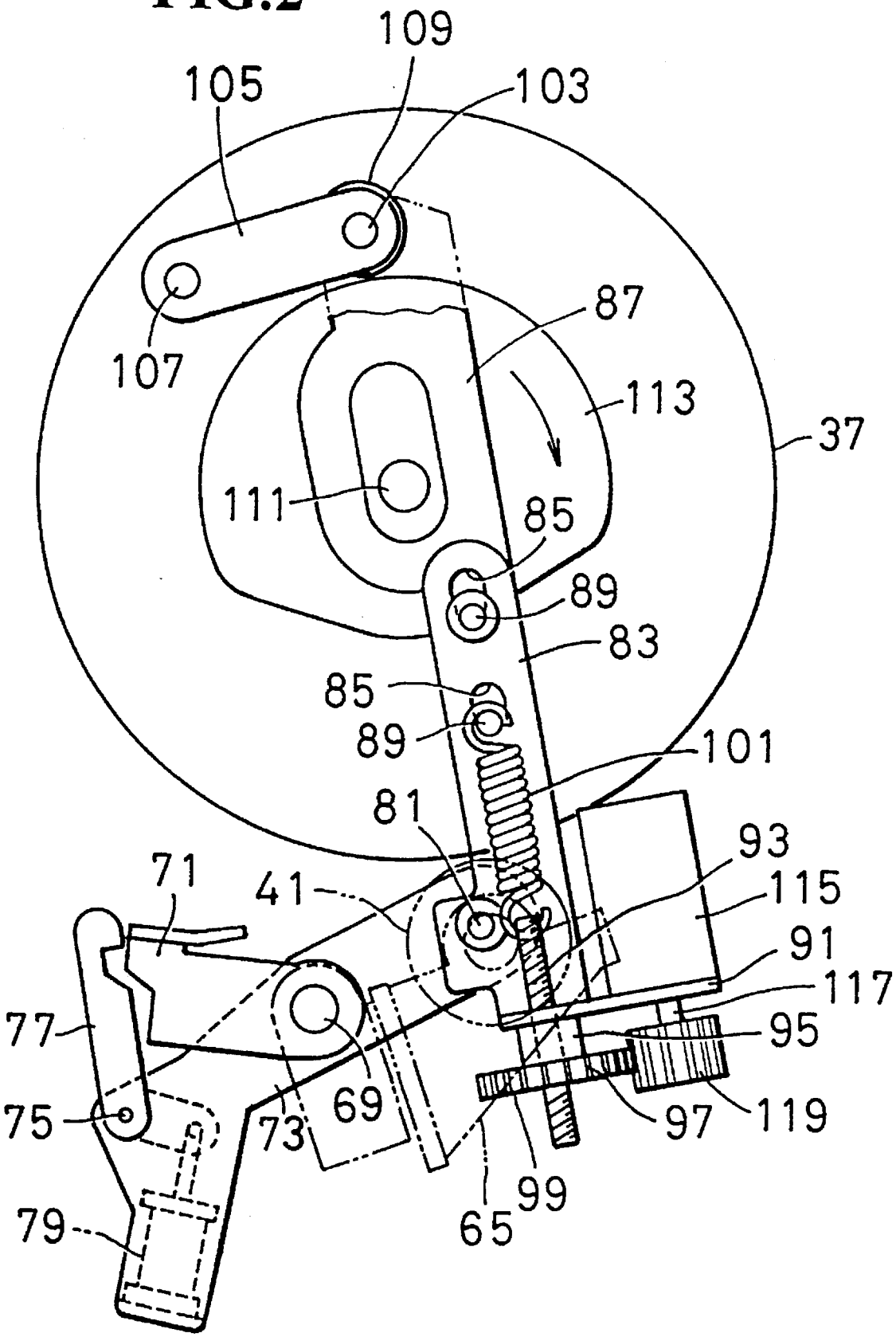
FIG. 2 is a rear view of an embodiment of the press roller drive unit which is used in the stencil printing device according to the present invention.

FIG. 2 shows the drive unit for the press roller 41. The press roller 41 is supported by a bracket 65, extending in the axial direction of the printing drum 37, so as to be rotatable around its central axial line, and the bracket 65 is in turn fixedly secured to a press shaft 69 rotatably supported by a fixed member or a frame not shown in the drawings. Thus, the press roller 41 is vertically rotatable around the press shaft 69, and can move between a retracted position spaced from the outer circumferential surface of the printing drum 37 and a position for pressing action engaged upon the outer circumferential surface of the printing drum 37.

The press shaft 69 carries a press drive lever 71 fixedly mounted thereof, and rotatably supports a press drive plate 73.

A hook member 77 is pivotably supported on the press drive plate 73 by means of a pivot shaft 75, and selectively engages with the press drive lever 71 by being rotatively driven by a solenoid 79 mounted on the press drive plate 73 for selectively engaging the press drive lever 71 with the press drive plate 73.

An end of a first link member 83 is pivotally connected to an end of the press drive plate 73 by means of a pivot shaft 81. The first link member 83 is provided with a pair of slots 85 extending in the same direction, and these slots 85 receive pins 89 of a second link member 87. Thus, the first link member 83 and the second link member 87 are connected with each other so as to be relatively moveable in the lengthwise direction or vertically as seen in FIG. 2 within the range permitted by the slots 85.

The lower end of the first link member 83 is provided with a bent flange piece 91 through which an adjust screw 93 is passed so as to be adjustable in the direction of the reciprocating movement of the first link member 83. The adjust screw 93 threads with a nut member 99 provided with outer teeth 97 in the manner of a spur gear and supported by the lower surface of the bent flange piece 91 by way of a collar 95 against a thrust force, and the upper end of the adjust screw 93 is connected to an end of a tensile coil spring 101.

The adjust screw 93 is thus prevented from rotating by being engaged by the one end of the tensile coil spring 101, and is axially displaced with respect to the first link member 83 by the rotation of the nut member 99.

The tensile coil spring 101 is engaged by one of the pins 89 at its other end, thus urging the first link member 83 upwards relative to the second link member 87, or in other words urging the press drive plate 73 in counter clockwise direction in FIG. 2 around the press shaft 69 to press the press roller 41 onto the outer circumferential surface of the printing drum 37.

The second link member 87 is pivotally connected to a free end portion of a cam lever 105 by a pivot shaft 103. The cam lever 105 is rotatably supported on a frame not shown in the drawing by a support shaft 107. The cam lever 105 rotatably supports a cam follower roller 109 in a freely rotatably manner. The cam follower roller 109 engages with a press cam 113 mounted on a main shaft 111. The press cam 113 rotates in synchronism with the printing drum 37, and is provided with a cam profile which moves the press roller 41 to its retracted position to avoid the interference between the press roller 41 and a clamp unit for a stencil master plate sheet when the clamp unit is located in a position corresponding to the press roller 41.

The bent flange piece 91 carries an electric motor 115 for adjusting the pressing force, and a drive gear 119 is fixedly secured to an output shaft 117 of the electric motor. The drive gear 119 meshes with the outer teeth 97 of the nut member 99 for transmitting the rotation of the output shaft 117 of the electric motor 115 for adjusting the pressing force.

In this press roller drive unit, the rotation of the printing drum 37 causes the press cam 113 to rotate in the clockwise direction as seen in FIG. 2, and this rotation in turn causes a substantially vertical reciprocating movement of the second link member 87 which is transmitted to the first link member 83 via the tensile coil spring 101. The reciprocating movement of the first link member 83 causes the press drive plate 73 to angularly reciprocate around the press shaft 69, and because the hook member 77 is moved into engagement with the press drive lever 71 by the solenoid 79, the reciprocating movement of the press drive plate 73 is transmitted to the press shaft 69. Thus, the reciprocating angular movement of the press shaft 69 causes the press roller 41 to vertically rotate around the press shaft 69 so that the press roller 41 may move between the retracted position spaced from the outer circumferential surface of the printing drum 37 and the pressing position pressed against the outer circumferential surface of the printing drum 37.

The movement of the press roller 41 to the pressing position is effected by the second link member 87 being lifted, by this movement being transmitted to the first link member 83 through tensioning of the tensile coil spring 101, and by the press drive plate 73 being rotated in counter clockwise direction as seen in FIG. 2 around the press shaft 69 of the press drive plate 73. Thus, the press roller 41 is pressed against the outer circumferential surface of the printing drum 37 with the printing paper P interposed therebetween, thereby restricting any further rotation of the press drive plate 73 in counter clockwise direction as seen in FIG. 2 around the press shaft 69. The second link member 87 is further lifted until the second link member 87 moves relative to the first link member 83 and the tensile coil spring 101 is extended. As a result, the spring force of the stretched tensile coil spring 101 presses the press roller 41 on the outer circumferential surface of the printing drum 37 with printing paper P interposed therebetween, and the magnitude of the pressing force is determined by this spring force.

For adjusting the pressing force, the electric motor 115 for the adjustment of the pressing force is activated, and the drive gear 119 is rotated. The rotation of the drive gear 119 is transmitted to the nut member 99, and the rotation of the nut member 99 causes the adjust screw 93 to move axially relative to the first link member 83, thereby changing the position of the adjust screw 93 relative to the first link member 83. As a result, the point of engagement between the tensile coil spring 101 and the adjust screw 93 moves axially relative to the first link member 83, and this displacement causes a change in the length of the tensile coil spring 101, and hence its preset spring force.

The change in the preset spring force of the tensile coil spring 101 changes the pressure or the pressing force by which the press roller 41 is pressed against the outer circumferential surface of the printing drum 37 as described above.

Figure 3:
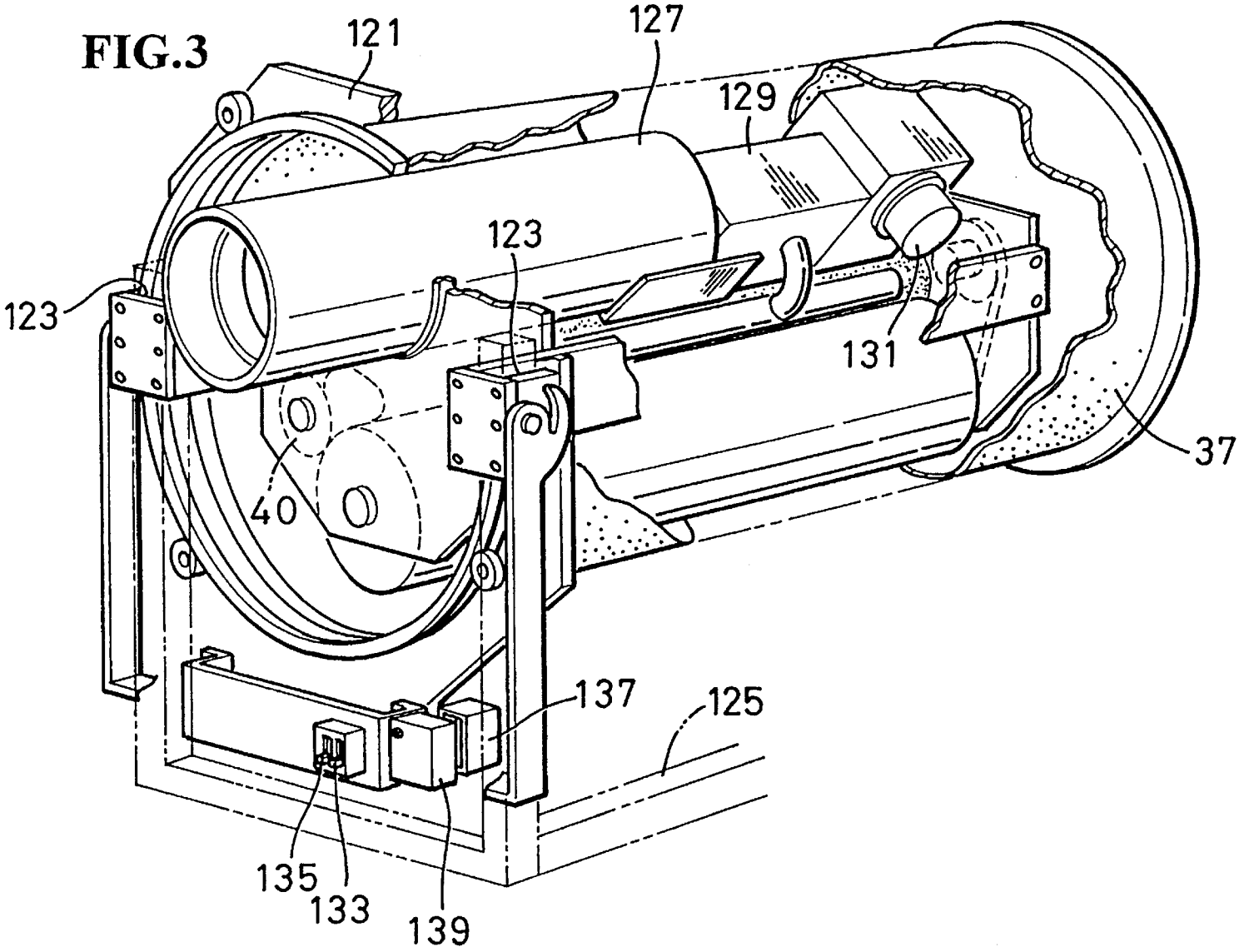
FIG. 3 is a perspective view of an embodiment of the interchangeable printing drum which is used in the stencil printing device according to the present invention.

The printing drum 37 is constructed as a part of a module in which the printing drum 37 is rotatably supported by a support plate 121 as illustrated in FIG. 3. This module is detachably engaged, by means of an engaging portion 123 provided in the support plate 121, with a moveable printing drum supporting frame 125 which is slidably mounted on a main body of a stencil printing device so that the module can be slid out of the main body of the stencil printing device.

The printing drum 37 is internally provided with an ink bottle 127 accommodating printing ink therein, an ink delivery pump 129 for drawing printing ink from the ink bottle 127 and delivering it to the ink supplying unit 39 (refer to FIG. 1), and an electric motor 131 for driving the ink delivery pump 129.

For more details of the detachable structure of a printing drum, reference should be made to Japanese patent publication (kokoku) No. 62-28758 and No. 04-46236.

In the printing drum 37 used in the above described stencil printing device, its porous structure is impregnated with printing ink. Therefore, each printing drum 37 can be assigned with printing ink of only one color, and different printing drums must be assigned for printing inks of different colors such as black, blue and red.

The support plate 121 is provided with dip switches 133 and 135 which may be turned on and off depending on the color of the printing ink that is being used. The dip switches 133 and 135 can set four different modes by different combinations of their on and off conditions. For instance, when both the dip switches 133 and 135 are turned off, it may mean that black printing ink is used. When the dip switch 133 is off and the dip switch 133 is on, it may then mean that red printing ink is used. In this manner, different colors of printing ink may be associated with different modes. If printing inks of different colors have a substantially identical material property, they may be associated with a same mode.

The support plate 121 is provided with a connector half 139 which is adapted to be connected to another connector half 137 provided in the main body of the stencil printing device when the printing drum 37 is mounted in the main body of the stencil printing device. By this electric connection established by the two connector halves 137 and 139, the on and off conditions of the dip switches 133 and 135 are transmitted to a control unit of the stencil printing device.

Figure 4:
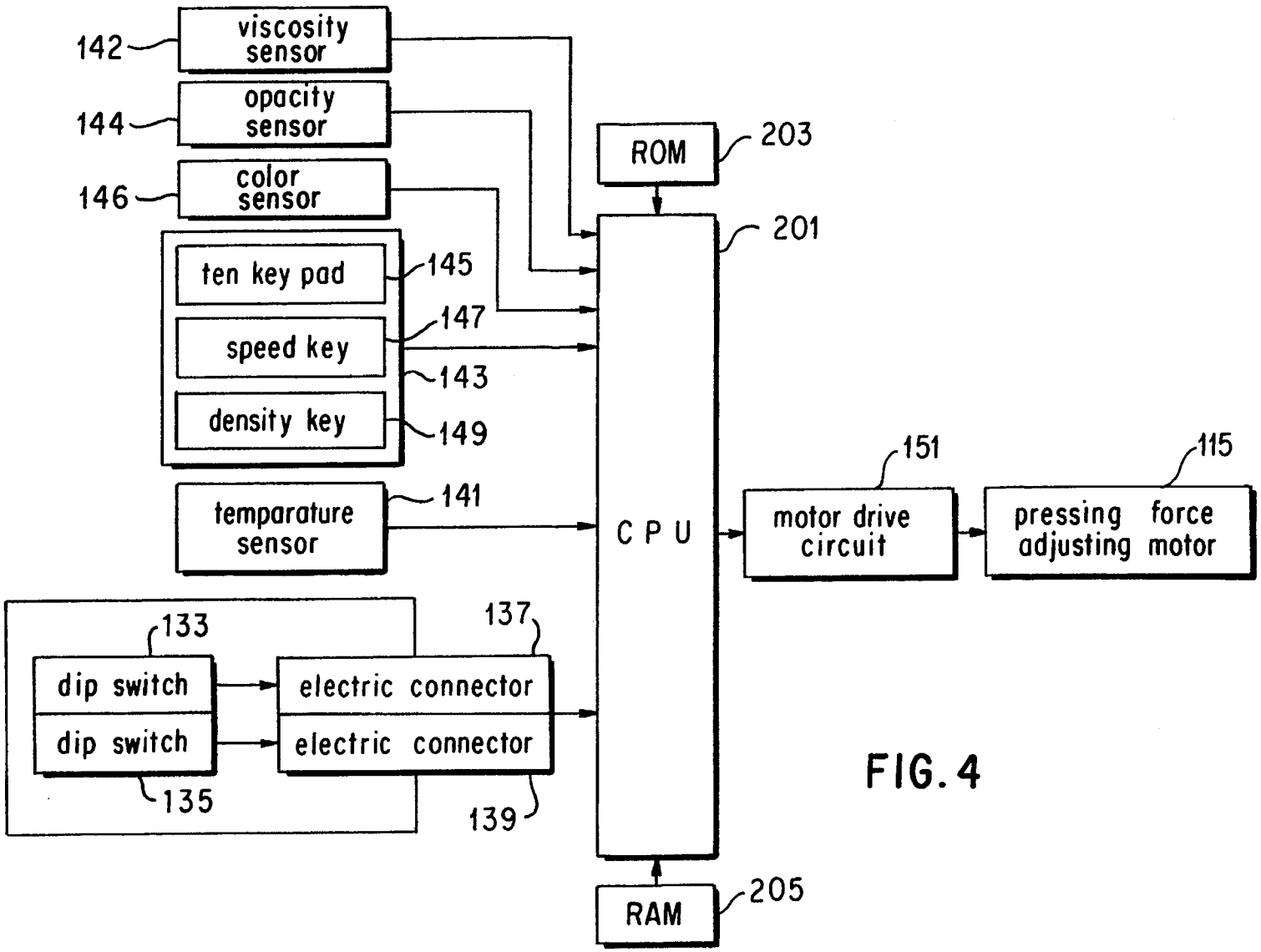
FIG. 4 is a block diagram showing an embodiment of the control unit for the stencil printing device according to the present invention.

The control unit generally controls the operation of the stencil printing device, including the control of the operation of the electric motor 115 for adjustment of the pressing force, and, as illustrated in FIG. 4, comprises a CPU 201 consisting of a micro processor or the like, ROM 203 storing programs for controlling the operation of various units in the stencil printing device, and RAM 205 storing, as required, the results of arithmetic operations carried out by the micro processor and input information of various kinds.

In FIG. 4, only the parts of the stencil printing device which are related to the present invention are illustrated for the simplification of description, and the CPU 201 receives temperature information indicating the temperature of the printing ink in the printing drum 37 detected by a temperature sensor 141 or a temperature otherwise representing the condition of the printing ink in the printing drum 37, information on the desired number of copies entered from a ten key pad 145 included in an operation panel 143 arranged on an upper surface of the cabinet for the stencil printing device, printing speed information selected by a printing speed set up key 147 provided in the operation panel 143, printing density information selected by a printing density set up key 149 provided in the operation panel 143, and the on and off information of the dip switches 133 and 135 or information on the color of the printing ink. Instead of temperature information, information regarding to the viscosity of the printing ink can be supplied from a viscosity sensor 142. Additionally, information regarding opacity or color of the printing ink can be supported from an opacity sensor 144 or color sensor 146, respectively. Based on these pieces of information, the CPU 201 determines the control value for the electric motor 115 for the adjustment of the pressing force, and supplies a control value signal to a motor drive circuit 151.

As the printing density set up by the printing density set up key 149 is increased, the control value of the electric motor 115 for the adjustment of the pressing force is changed and the electric motor 115 is turned in such a manner that the pressing force is increased. Likewise, so that the printing of a prescribed density may be carried out irrespective of the change in temperature and the printing speed, the electric motor 115 for the adjustment of the pressing force is turned in such a manner that the pressing force is increased as the temperature detected by the temperature sensor 141 rises and as the printing speed set up by the printing speed set up key 147 is increased. Additionally, so that a printing of a prescribed density may be carried out irrespective of the change in the color of the printing ink, the electric motor 115 for the adjustment of the pressing force is turned in such a manner that the pressing force is increased or decreased by a prescribed amount depending on the on/off information of the dip switches 133 and 135.

The prescribed amount by which the pressing force is changed for the purpose of achieving a prescribed printing density is determined according to the viscosity of the printing ink which in turn depends on the kinds of pigments used and their particle sizes, and the tinting strength or the opacity of the printing ink. This amount may be determined experimentally.

Figure 5:
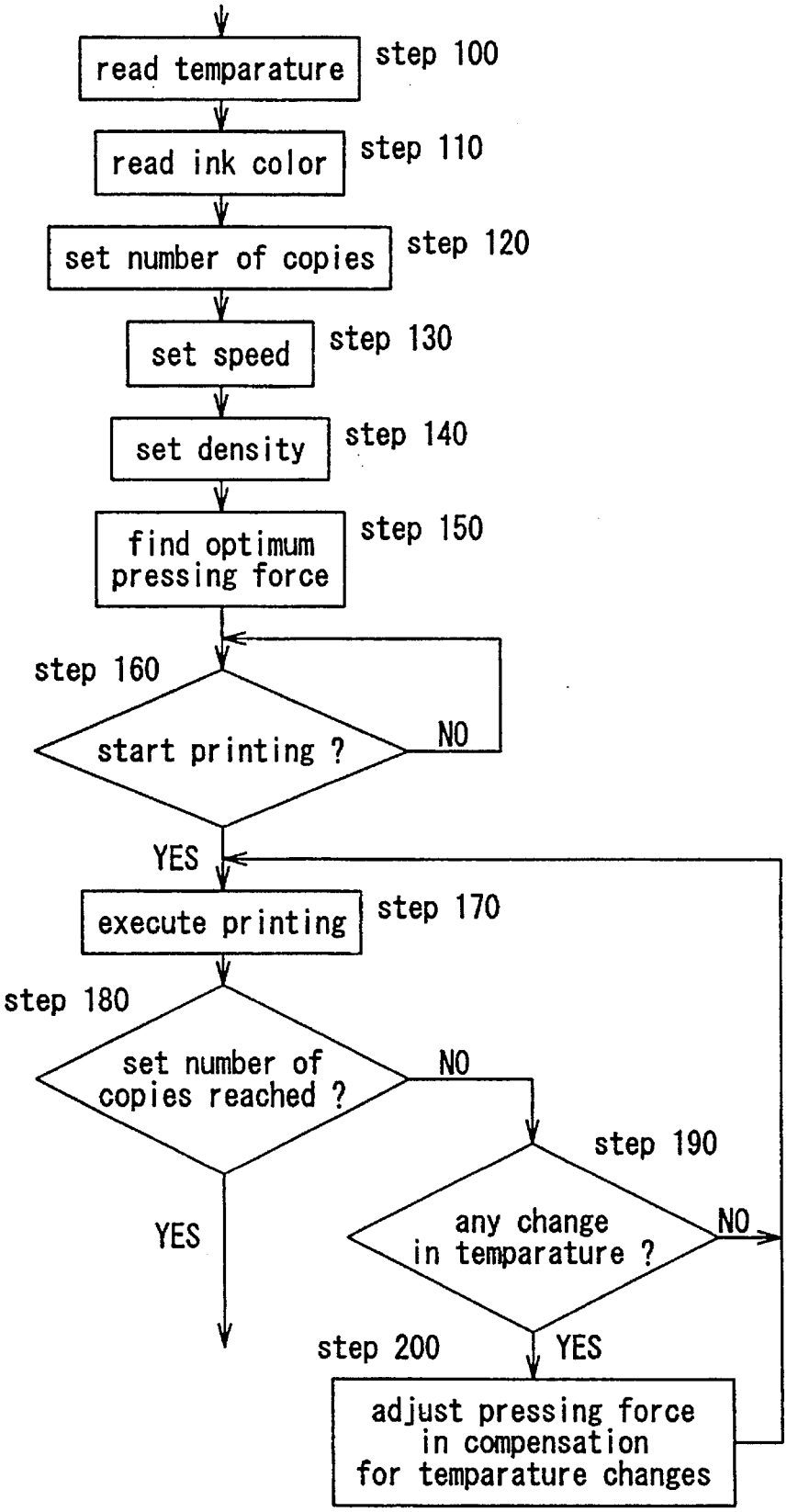
FIG. 5 is a flow chart showing the control flow related to the adjustment of the printing density in the stencil printing device according to the present invention.

FIG. 5 shows the control flow of the adjustment of the printing density of the stencil printing device according to the present invention. In this control flow, first of all, temperature information is read by the temperature sensor 141 (step 100), and printing color information is read according to the on/off conditions of the dip switches 133 and 135 (step 110). The information thus read is stored in the RAM 205.

Then, copy number information set up on the ten key pad 145 of the operation panel 143, printing speed information set up on the printing speed set up key 147 of the operation panel 143, and printing density information set up on the printing density set up key 149 of the operation panel 143 are read in a sequential manner, and the information thus read is stored in the RAM 205 (steps 120 through 140).

Then, the CPU 201 computes an optimum pressing force or looks it up on a data table according to the information stored in the RAM 205 or according to the temperature, the printing speed, the printing density and the color of the printing ink, and the control signal corresponding to this optimum pressing force is supplied to the motor drive circuit 151. As a result, the electric motor 115 for the adjustment of the pressing force is turned, and the nut member 99 is rotated until the pressing force is set to the optimum value and the set load of the tensile coil spring 101 is set to the optimum value (step 150).

It is then determined if the print start key provided in the operation panel 143 although not shown in the drawings is pressed or not, or if a printing is to be started or not (step 160), and a printing process is executed if a printing process is to be started (step 170).

This printing process is continued until the set number of copies have been printed (step 180). The change in temperature detected by the temperature sensor 141 is monitored after each sheet of printing paper P is printed (step 190), and if any change in temperature is detected, the temperature compensatory value of the pressing force is computed or looked up from the data table, the control signal according to the temperature compensatory value is supplied to the motor drive circuit 151. As a result, the electric motor 115 for the adjustment of the pressing force is turned, and the set load of the tensile coil spring 101 is set to the optimum value or the temperature adjustment of the pressing force is carried out so that the pressing force and the printing density may not be changed (step 200).

According to the above described structure, when the on/off conditions of the dip switches 133 and 135 of the printing drum 37 are set up for each printing drum 37 according to the color of the printing ink used with the associated printing drum 37, and the printing drum 37 mounted on the main body of the stencil printing device is changed for changing the color of the printing drum 37, the CPU 201 detects the on/off conditions of the dip switches 133 and 135 of the printing drum 37 mounted on the main body of the stencil printing device, and automatically determines the optimum pressing force for the selected color according to the color of the printing ink thus detected.

In the above described embodiment, it was possible to set up four modes according to different on/off combinations of the dip switches 133 and 135. If a larger number of different modes are required, the number of the dip switches may be increased. The detection of the color of the printing ink can be made not only by the setting of the dip switches but by an identification process based on the use of bar codes and other coded information, identification marks which can be photoelectrically detected, and magnetic pieces arranged in suitable combinations (as shown in FIG. 4 by reference number 152). The color of the printing ink can be also detected by providing a sensor in the stencil printing device for identifying the color of the printing ink.

The pressing force may be automatically adjusted depending on the composition, the material property, and the water content of the printing ink in addition to the color of the printing ink.

As can be understood from the above description, according to the stencil printing device of the present invention, the pressing force (pressure) of the press roller upon the printing drum is automatically set to an optimum value according to the type, in particular the color of the printing ink, and a stencil printing of a desired printing density can be achieved without regard to the type, in particular the color of the printing ink without requiring any manual fine adjustment.

Although the present invention has been described in terms of a specific embodiment thereof, it is possible to modify and alter details thereof without departing from the spirit of the present invention.

What we claim is:

1. A stencil printing device for carrying out a stencil printing on printing paper by pressing said printing paper with a press roller upon a stencil master plate sheet mounted on an outer circumferential surface of a cylindrical printing drum having printing ink supplied to an inner surface of said printing drum, comprising:

ink type detecting means for detecting a color of said printing ink supplied to the inner surface of said printing drum;

pressing force varying means for variably setting the magnitude of a pressure of a press roller exerted upon said printing drum according to said color of said printing ink detected by said ink type detecting means; and control means for controlling said pressure of said press roller exerted upon a printing drum so as to drive said press force varying means according to said color of said printing ink detected by said ink type detection means.

2. A stencil printing device for carrying out a stencil printing on printing paper by pressing said printing paper with a press roller upon a stencil master plate sheet, comprising:

a plurality of cylindrical printing drum each having an inner surface for receiving a supply of printing ink and an outer circumferential surface for mounting a stencil master plate sheet;

means for detachably mounting one of said plurality of printing drums so as to be interchangeable with another one of said plurality of printing drums for using a different color printing ink, wherein a single printing drum is mounted in the stencil printing device at a given time;

ink type detecting means for detecting a color of said printing ink supplied to the inner surface of said printing drum;

pressing force varying means for variably setting the magnitude of a pressure of a press roller exerted upon said printing drum according to said color of said printing ink detected by said ink type detecting means; and control means for controlling said pressure of said press roller exerted upon said printing drum so as to drive said press force varying means according to said color of said printing ink detected by said ink type detecting means; and each printing drum being provided with switch means whose setting is associated with said different color of said printing ink associated with each of said plurality of printing drums and whose setting can be detected by said ink type detecting means provided in said stencil printing device.

3. A stencil printing device for carrying out a stencil printing on printing paper by pressing said printing paper with a press roller upon a stencil master plate sheet mounted on an outer circumferential surface of a cylindrical printing drum having printing ink supplied to an inner surface of said printing drum, comprising:

ink type detecting means for detecting a color of said printing ink supplied to the inner surface of said printing drum;

pressing force varying means for variably setting the magnitude of a pressure of a press roller exerted upon said printing drum according to said color of said printing ink detected by said ink type detecting means; and control means for controlling said pressure of said press roller exerted upon a printing drum so as to drive said press force varying means according to said color of said printing ink detected by said ink type detection means; and wherein said ink type detecting means further comprises a sensor for directly detecting another material property of said printing ink.

4. A stencil printing device for carrying out a stencil printing on printing paper by pressing said printing paper with a press roller upon a stencil master plate sheet mounted on an outer circumferential surface of a cylindrical printing drum having printing ink supplied to an interior surface of said printing drum, comprising:

a printing drum having information indicating a color of a printing ink supplied to the interior surface of said printing drum;

detecting means for detecting said information indicating said color of said printing ink supplied to said printing drum which is mounted in the stencil printing device;

pressing force varying means for varying the magnitude of pressure of a press roller exerted upon said printing drum; and control means for controlling said pressure of said press roller exerted upon said printing drum so as to drive said pressing force varying means according to said color of said printing ink detected by said detecting means.

5. A stencil printing device according to claim 4, further comprising drive data storage means for storing drive data for driving said pressing force varying means according to said color of said printing ink.

6. A stencil printing device according to claim 4, further comprising a sensor provided on said printing drum, wherein said information of said color of said printing ink is detected by said sensor.

7. A stencil printing device for carrying out a stencil printing on printing paper by pressing said printing paper with a press roller upon a stencil master plate sheet mounted on an outer circumferential surface of a cylindrical printing drum having printing ink supplied to an interior surface of said printing drum, comprising:

a switch means;

a printing drum having information indicating a color of a printing ink supplied to the interior surface of said printing drum;

detecting means for detecting said information indicating said color of said printing ink supplied to said printing drum which is mounted in the stencil printing device;

pressing force varying means for varying the magnitude of pressure of a press roller exerted upon said printing drum; and control means for controlling said pressure of said press roller exerted upon said printing drum so as to drive said pressing force varying means according to said color of said printing ink detected by said detecting means; and wherein said information of said color of said printing ink is detected by said switch means, provided on said printing drum.

8. A stencil printing device for carrying out a stencil printing on printing paper by pressing said printing paper with a press roller upon a stencil master plate sheet mounted on an outer circumferential surface of a cylindrical printing drum having printing ink supplied to an interior surface of said printing drum, comprising:

printing speed set means for setting a printing speed to be printed by said device;

printing density set means for setting a printing density to be printed to said printing paper;

temperature detecting means for detecting a temperature of said-printing ink supplied to the interior surface of said printing drum:

a printing drum having information indicating a color of a printing ink supplied to the interior surface of said printing drum;

detecting means for detecting said information indicating said color of said printing ink given to said printing drum which is mounted in said stencil device;

pressing force varying means for varying the magnitude of a pressure of a press roller exerted upon said printing drum; and control means for controlling said pressure of said press roller exerted upon said printing drum so as to drive said pressing force varying means according to printing speed information set by said printing speed set means, printing density information set by said printing density set means, temperature information detected by said temperature detecting means, and said color of said printing ink detected by said detecting means.

9. A stencil printing device according to claim 8, further comprising drive data storage means for storing drive data for driving said pressing force varying means according to said printing speed information, printing density information, temperature information, and said color of printing ink.

* * * * *